US010507848B2

(12) United States Patent
Demarquilly et al.

(10) Patent No.: US 10,507,848 B2
(45) Date of Patent: Dec. 17, 2019

(54) RAILWAY VEHICLE WITH A MOVABLE, VERTICAL GAP BRIDGING ENTRY THRESHOLD

(71) Applicant: Alstom Transport Technologies, Saint-Ouen (FR)

(72) Inventors: Francis Demarquilly, Lagord (FR); Eric Combeau, Niort (FR); Frédéric Le-Breton, Nieul sur Mer (FR)

(73) Assignee: Alstom Transport Technologies, Saint-Ouen (FR)

( * ) Notice: Subject to any disclaimer, the term of this patent is extended or adjusted under 35 U.S.C. 154(b) by 191 days.

(21) Appl. No.: 15/525,451

(22) PCT Filed: Nov. 19, 2014

(86) PCT No.: PCT/IB2014/002907
§ 371 (c)(1),
(2) Date: May 9, 2017

(87) PCT Pub. No.: WO2016/079559
PCT Pub. Date: May 26, 2016

(65) Prior Publication Data
US 2017/0334464 A1 Nov. 23, 2017

(51) Int. Cl.
*B61D 23/02* (2006.01)
*B61D 1/00* (2006.01)

(52) U.S. Cl.
CPC ..... *B61D 23/025* (2013.01); *B61D 1/00* (2013.01)

(58) Field of Classification Search
CPC ..... B61D 23/025
See application file for complete search history.

(56) References Cited

U.S. PATENT DOCUMENTS 3,651,767 A * 3/1972 Findeklee ..... B61D 23/025 105/448
3,672,311 A * 6/1972 Duba ..... B61D 23/025 105/447

(Continued)

FOREIGN PATENT DOCUMENTS

DE 2619204 A1 11/1977
DE 19531284 A1 2/1997

(Continued)

OTHER PUBLICATIONS

International Search Report dated Aug. 10, 2015, issued in corresponding PCT International Application No. PCT/IB2014/002907.

*Primary Examiner* — Jason C Smith
(74) *Attorney, Agent, or Firm* — Troutman Sanders LLP

(57) ABSTRACT

A railway vehicle for passenger transport comprising a vehicle body, said vehicle body including a passenger entrance area and a vehicle boarding aid for facilitating passengers' access to the passenger entrance area, the vehicle boarding aid comprising a movable entry threshold arranged in an access position facilitating passengers' access to the passenger entrance area and a vertical position adjusting device for vertically adjusting the access position of the entry threshold as a function of a potential vertical gap between a station platform and the passenger entrance area, wherein said entry threshold is fixedly arranged in said access position in all operating states of the railway vehicle.

17 Claims, 5 Drawing Sheets

(56) References Cited

U.S. PATENT DOCUMENTS 3,913,497 A * 10/1975 Maroshick ..... B61D 23/02 105/447
5,775,232 A * 7/1998 Golemis ..... B61D 23/025 105/458
6,167,816 B1 * 1/2001 Lavery ..... B61D 23/025 105/458
2007/0200313 A1 * 8/2007 Tazreiter ..... B60R 3/02 280/166
2008/0276832 A1 * 11/2008 Chisena ..... B61D 23/025 105/458
2009/0184486 A1 * 7/2009 Kircher ..... A61G 3/061 280/166
2009/0184487 A1 * 7/2009 Kircher ..... A61G 3/061 280/166
2010/0320714 A1 * 12/2010 Webb ..... B60R 3/02 280/166
2011/0133426 A1 * 6/2011 Coochesfahani ..... B60R 3/02 280/166
2014/0352572 A1 * 12/2014 Basily ..... B61D 23/025 105/450
2015/0083023 A1 * 3/2015 Hirashima ..... B61D 23/025 105/447
2015/0352992 A1 * 12/2015 Hirtenlehner ..... B61D 23/025 280/291
2017/0137038 A1 * 5/2017 Krueger ..... B61D 23/025
2017/0327022 A1 * 11/2017 Rasekhi ..... B61D 23/025
2017/0334464 A1 * 11/2017 Demarquilly ..... B61D 23/025
2018/0312142 A1 * 11/2018 Walter ..... B61D 23/025

FOREIGN PATENT DOCUMENTS

EP 1310417 A1 5/2003
FR 2349481 A2 11/1977
NL 7704729 A 11/1977

* cited by examiner

RAILWAY VEHICLE WITH A MOVABLE, VERTICAL GAP BRIDGING ENTRY THRESHOLD

CROSS-REFERENCE TO RELATED APPLICATION

This is a U.S. national phase application under 35 U.S.C. § 371 of International Patent Application No. PCT/IB2014/002907, filed Nov. 19, 2014. The entire contents of which are hereby incorporated by reference.

FIELD OF TECHNOLOGY

The present invention relates to a railway vehicle for passenger transport comprising a vehicle body, said vehicle body including:

- a passenger entrance area; and
- a vehicle boarding aid for facilitating passengers' access to the passenger entrance area, the vehicle boarding aid comprising:
  - a movable entry threshold arranged in an access position facilitating passengers' access to the passenger entrance area; and
  - a vertical position adjusting device for vertically adjusting the access position of the entry threshold as a function of a potential vertical gap between a station platform and the passenger entrance area.

BACKGROUND

Such a railway vehicle is disclosed by document DE 195 31 284 A1. This known railway vehicle features a vehicle boarding aid for wheelchair users. The vehicle boarding aid is normally stowed away under the railway vehicle, below a passenger entrance area of the railway vehicle. When a wheelchair user wants to board the railway vehicle, the vehicle boarding aid is deployed from under the railway vehicle towards the station platform. More specifically, the whole vehicle boarding aid first slides towards an outer side of the railway vehicle into a first intermediate position. Then, a tread of the vehicle boarding aid is rotated upwardly so that the vehicle boarding aid is in a second intermediate position. Finally, an entry threshold of the tread is rotated upwardly in order to bring the vehicle boarding aid into its final boarding position. The vertical position of the entry threshold may be adjusted to accommodate for height differences between the passenger entrance area and a station platform.

This known vehicle boarding aid has a lot of moving parts. Also, its deployment and retraction is time consuming. Indeed, the vehicle boarding aid can only be operated once the railway vehicle has safely stopped next to a platform. Hence, the deployment and retraction substantially increases the railway vehicle's station staying time. Furthermore, when a malfunction causes the vehicle boarding aid to be jammed in its deployed position, the railway vehicle is blocked at the railway station until a manual operation is done to solve the trouble. Indeed, the jammed vehicle boarding aid protrudes across the railway vehicle's loading gauge so that there is a collision risk if the railway vehicle were to leave the railway station.

On top of that, this known vehicle boarding aid is not adapted for modern low floor trams, such as the applicant's Citadis trams. There is no space under modern low floor trams for accommodating a bulky vehicle boarding aid. Also, modern low floor trams typically operate on lines having tram stations with dedicated station platforms that are designed such that there is a negligible horizontal gap between the tram's passenger entrance areas and the platform. In this context, the only issue is a potential vertical gap between the passenger entrance area and the platform. Thus, there is no need for a complex vehicle boarding aid such as the one disclosed by document DE 195 31 284 A1.

SUMMARY

Hence, an object of the present invention is to provide a railway vehicle with a simple, inexpensive and easily adjustable vehicle boarding aid. A further aim is to implement the vehicle boarding aid such that the railway vehicle can still operate even in case of a vehicle boarding aid malfunction. Still a further object is to provide a vehicle boarding aid that can be operated without increasing the railway vehicle's station staying time.

The above objects are achieved by a railway vehicle as defined above, characterised in that said entry threshold is fixedly arranged in said access position in all operating states of the railway vehicle.

By mounting the entry threshold directly in the access position and reducing its possible displacement to a vertical adjustment, the vehicle boarding aid is greatly simplified. It can also be operated quickly and with ease since this only involves a small vertical displacement of the entry threshold, depending on the vertical gap between the station platform and the passenger entrance area.

According to preferred examples, the inventive railway vehicle may comprise one, several or all of the following features, in all technically feasible combinations:

- the entry threshold is adapted to remain within the railway vehicle's loading gauge in all operating states of the railway vehicle;
- said entry threshold has an outer access end for stepping into the passenger entrance area, and an inner pivot end about which it can pivot around a horizontal axis to vertically adjust the access position of the entry threshold;
- said passenger entrance area includes an entrance floor and said inner pivot end is attached to the vehicle body in the area of the entrance floor;
- the vertical position adjusting device is adapted to act on the entry threshold's outer access end;
- the angular amplitude of the entry threshold's pivoting movement is less than 16;
- the vertical position adjusting device is arranged below the entry threshold;
- the vertical position adjusting device comprises an actuator, such as an electric jack, a hydraulic cylinder or a pneumatic cylinder;
- the actuator is attached to an outer side wall of the vehicle body, preferably via a ball joint;
- the actuator is attached to the underside of the vehicle body;
- the vertical position adjusting device comprises a linkage connecting the actuator to the entry threshold, said linkage being adapted to convert a movement of the actuator into a vertical displacement of the entry threshold;
- the railway vehicle is a tram, and in particular a low floor tram;
- a vehicle body suspension supporting the vehicle body, said vehicle body suspension being adapted to expand or collapse vertically as a function of the vehicle body's passenger load, a sensor arrangement adapted to provide a measure for the vehicle body's passenger load, and a controller adapted to control the vertical position adjusting device as a function of the measure provided by the sensor arrangement.

The invention also pertains to a method of vertically adjusting the access position of the entry threshold of the railway vehicle as defined above, comprising the following steps:

a) keeping the access position of the entry threshold at a default height when the railway vehicle is travelling from a first railway station having a first station platform to a second railway station having a second station platform;

b) using said sensor arrangement, measuring the vehicle body's passenger load and thus the size of the vehicle body suspension's current collapse;

c) when the railway vehicle has stopped at the second railway station, controlling the vertical position adjusting device to vertically adjust the access position of the entry threshold as a function of the measured passenger load, thus compensating a potential vertical gap between the passenger entrance area and the second station platform; and d) when the railway vehicle leaves the second railway station, controlling the vertical position adjusting device to move the entry threshold back to the access position's default height.

BRIEF DESCRIPTION OF THE DRAWINGS

Examples of the invention will now be described in detail with reference to the appended drawings, wherein.

DETAILED DESCRIPTION

Figure 1:
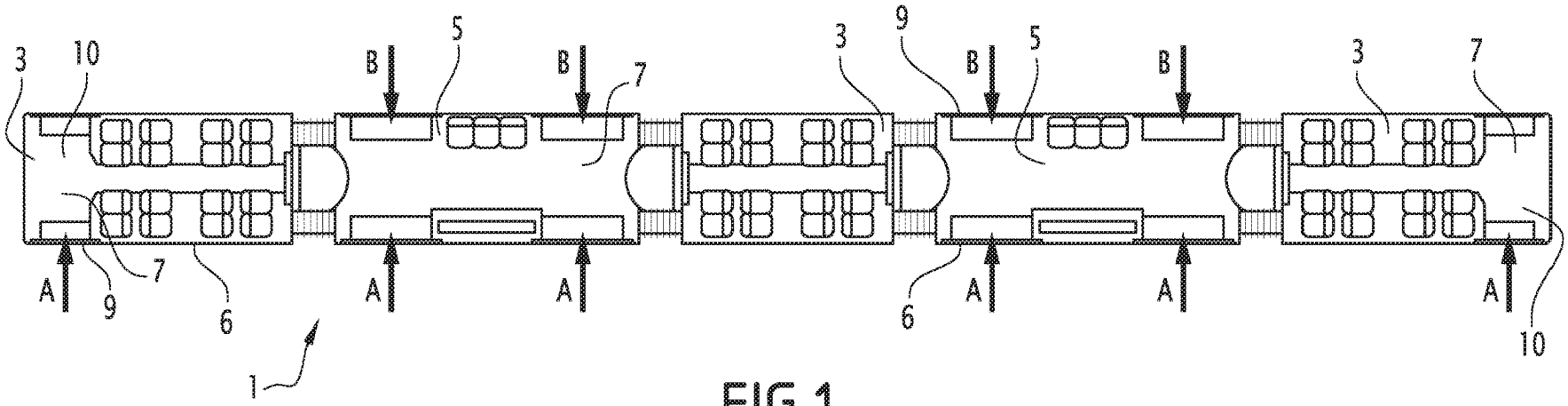
FIG. 1 is a longitudinal section, seen from the top, of a tramway according to the invention.

With reference to FIG. 1, there is shown a tramway 1 according to the invention. Preferably, tramway 1 is a low floor tram such as the Citadis trams manufactured by the applicant. Tramway (Tram set) 1 can for example have a total of five passenger compartments, namely three seating compartments 3 and two open space compartments 5. The open space compartments 5 are designed to accommodate wheelchairs or pushchairs and/or are adapted to disabled people. Each compartment 3, 5 has a body 6 with one or more passenger entrance areas 7 that are opened and closed with doors 9. Each passenger entrance area 7 has an entrance floor 10.

The inventive vehicle boarding aid facilitates access to the tramway 1, in particular for wheelchair users and other disabled people, or for parents with pushchairs. The inventive vehicle boarding aid can either be installed at each of the doors 9 of the tram 1, as indicated by arrows A, or only at the doors 9 of the open space compartments 5, as indicated by arrows B.

Figure 2:
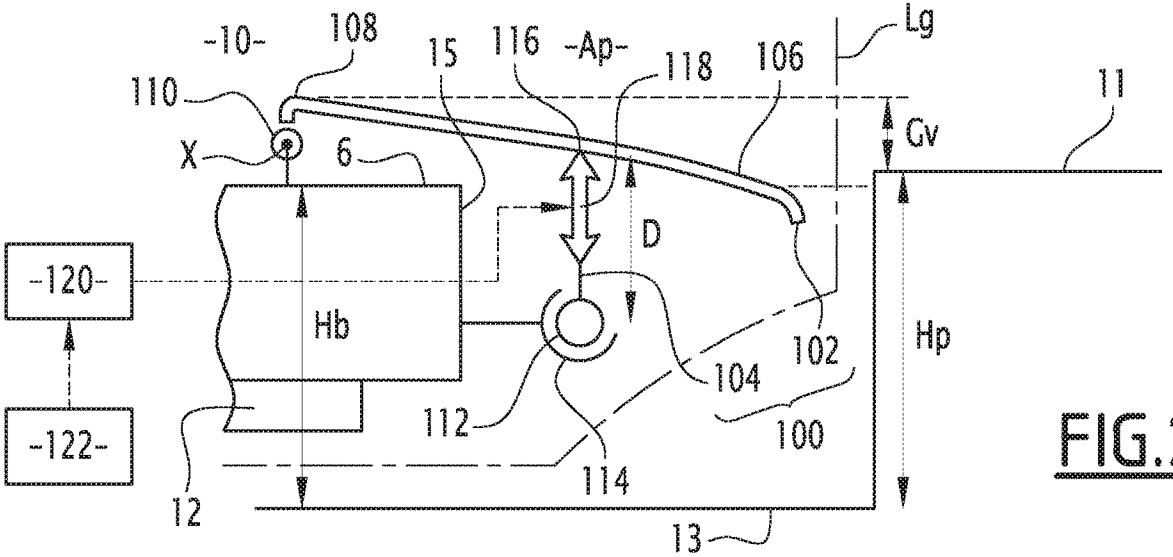
FIG. 2 shows an example of an inventive vehicle boarding aid, in a configuration with no passenger load.
Figure 3:
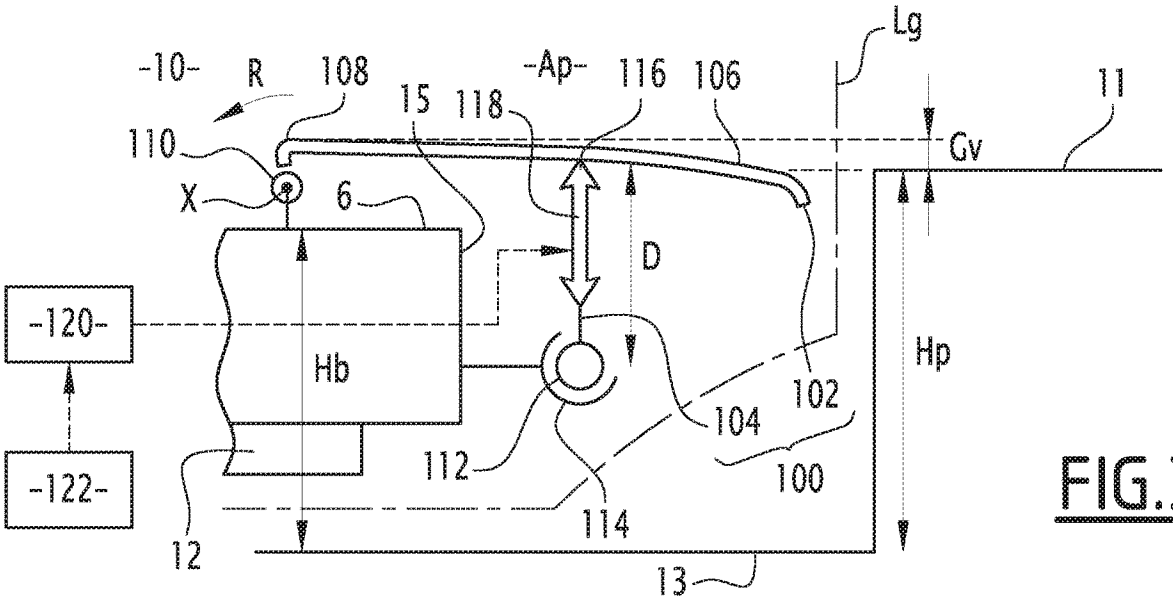
FIG. 3 shows the vehicle boarding aid of FIG. 2 in a configuration with high passenger load.

An example 100 of the inventive vehicle boarding aid is shown in FIGS. 2 and 3. In FIGS. 2 and 3, tram 1 stops at the platform 11 of a tram station. Platform 11 is located at a height Hp above rail level 13. The upper end of body 6 of compartments 3, 5 is located at a height Hb above rail level 13. Body 6 is supported by a suspension 12.

Vehicle boarding aid 100 is designed such that it always remains within the tram's loading gauge Lg (indicated by a chain-dotted line), regardless of the vehicle boarding aid's operating state.

Vehicle boarding aid 100 comprises a pivotable entry threshold 102 and a vertical position adjusting device 104. Entry threshold 102 has an outer access end 106 for stepping into the passenger entrance area 7, and an inner pivot end 108 about which it can pivot around a horizontal axis X. The entry threshold's inner pivot end 108 is attached to the body 6 in the area of the entrance floor 10 via a pivot joint 110. Preferably, the outer access end 106 is bent downwards.

Entry threshold 102 is fixedly arranged on the body 6 in an access position Ap. The access position Ap is a position in which a passenger can step from platform 11 onto entry threshold 102 to enter the passenger entrance area 7. In other words, entry threshold 102 always remains in the access position Ap, in all operating states of tram 1. Hence, entry threshold 102 always guarantees access to tram 1.

Vertical position adjusting device 104 is designed to vertically adjust the access position Ap of the entry threshold 102 as a function of a potential vertical gap Gv between the station platform 11 and the entrance floor 10. Vertical position adjusting device 104 is positioned below entry threshold 102. A supporting end 112 of vertical position adjusting device 104 is attached to an outer side wall 15 of body 6, preferably via a ball joint 114. An adjusting end 116 of vertical position adjusting device 104 is attached to entry threshold 102. Preferably, the adjusting end 116 acts on the outer access end 106.

Vertical position adjusting device 104 can linearly expand and contract in order to modify the distance D between the entry threshold 102 and its supporting end 112.

In order to modify the distance D, vertical position adjusting device 104 comprises an actuator 118, such as an electric jack, a hydraulic cylinder or a pneumatic cylinder.

The actuator 118 is controlled via a controller 120. Preferably, controller 120 corresponds to the Train Control Management System (TCMS) of tram 1. Controller 120 receives an input from a sensor arrangement 122 that provides a measure for the passenger load of body 6. Preferably, sensor arrangement 122 includes a load sensor or a passenger counting sensor. Sensor arrangement 122 may also comprise an optical sensor, e.g. a laser sensor, preferably mounted on the outside of tram body 6, adapted to measure the vertical distance between the station platform 11 and the entrance floor 10.

FIG. 2 illustrates the configuration of the inventive vehicle boarding aid 100 when no passengers are present in tram body 6. The suspension 12 is in an expanded state and there is a substantial vertical gap Gv between the entrance floor 10 and the platform 11. Thanks to the load sensor 122, controller 120 is aware that there is no passenger load. Controller 120 has therefore retracted actuator 118 so that the access position Ap of entry threshold 102 is tilted downwardly. Consequently, entry threshold 102 bridges vertical gap Gv, thus facilitating access to tram body 6.

FIG. 3 illustrates the configuration of the inventive vehicle boarding aid 100 when a large number of passengers are present in tram body 6. The suspension 12 is in a collapsed state and there is only a small vertical gap Gv between the entrance floor 10 and the platform 11. Thanks to the load sensor 122, controller 120 is aware that there is a high passenger load. Controller 120 has therefore extended actuator 118, thus pivoting entry threshold 102 upwardly around horizontal axis X (as indicated by arrow R). Accordingly, the access position Ap of entry threshold 102 is substantially horizontal. Entry threshold 102 bridges the small vertical gap Gv, thus facilitating access to tram body 6.

Figure 4:
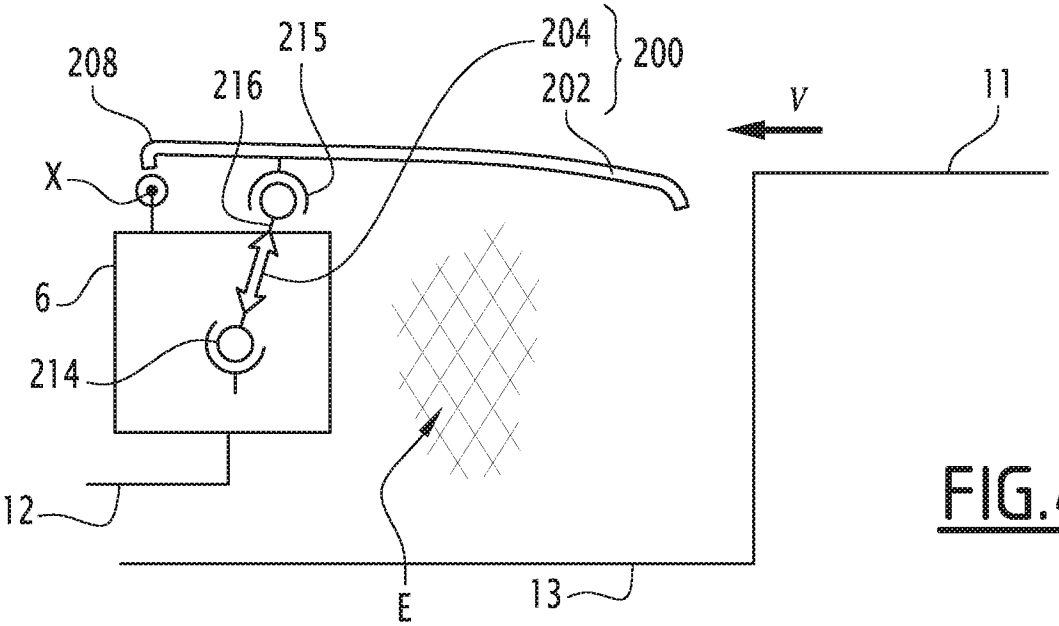
FIGS. 4 and 5 show another example of an inventive vehicle boarding aid.
Figure 5:
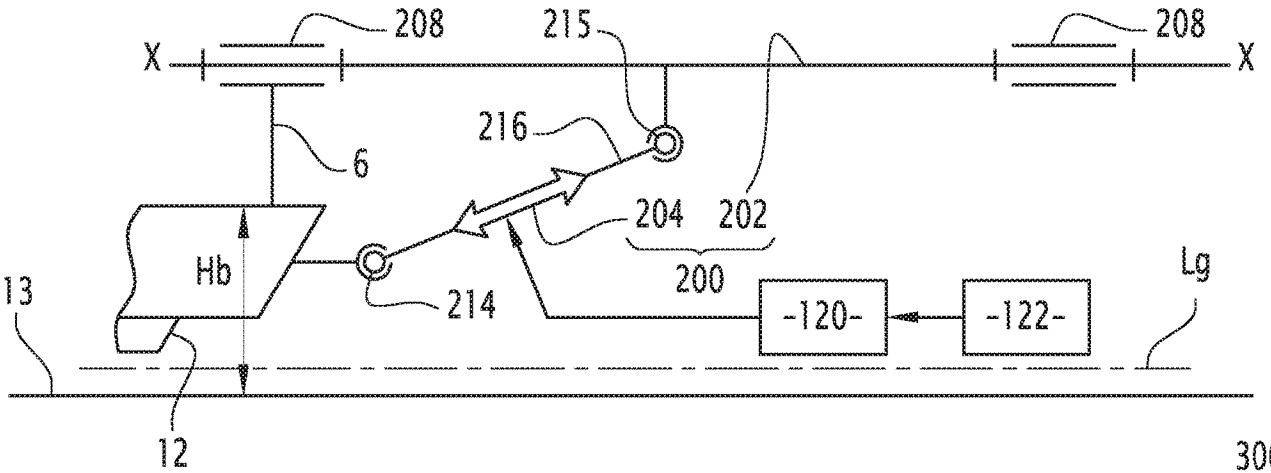

FIG. 4 is a cross-sectional view of another example 200 of the vehicle boarding aid according to the invention. FIG. 5 is a longitudinal external side view of the other example 200 according to arrow V in FIG. 4.

Vehicle boarding aid 200 is different from vehicle boarding aid 100 in that the adjusting end 216 of vertical position adjusting device 204 is connected to entry threshold 202 via a joint 215, in particular a ball joint. Thanks to the joint 215, the vertical position adjusting device 204 of this example 200 has an inclined orientation and thus takes up less space in the vertical direction compared to the vertical position adjusting device 104 of the previous example 100 with its generally vertical orientation. In particular, vertical position adjusting device 204 is arranged such that the space E corresponding to the gap between car body 6 and station platform 11 (cf. FIG. 4) is not obstructed. With reference to FIG. 5, entry threshold 202 can rotate around a horizontal axis X located at the inner pivot end 208.

Figure 6:
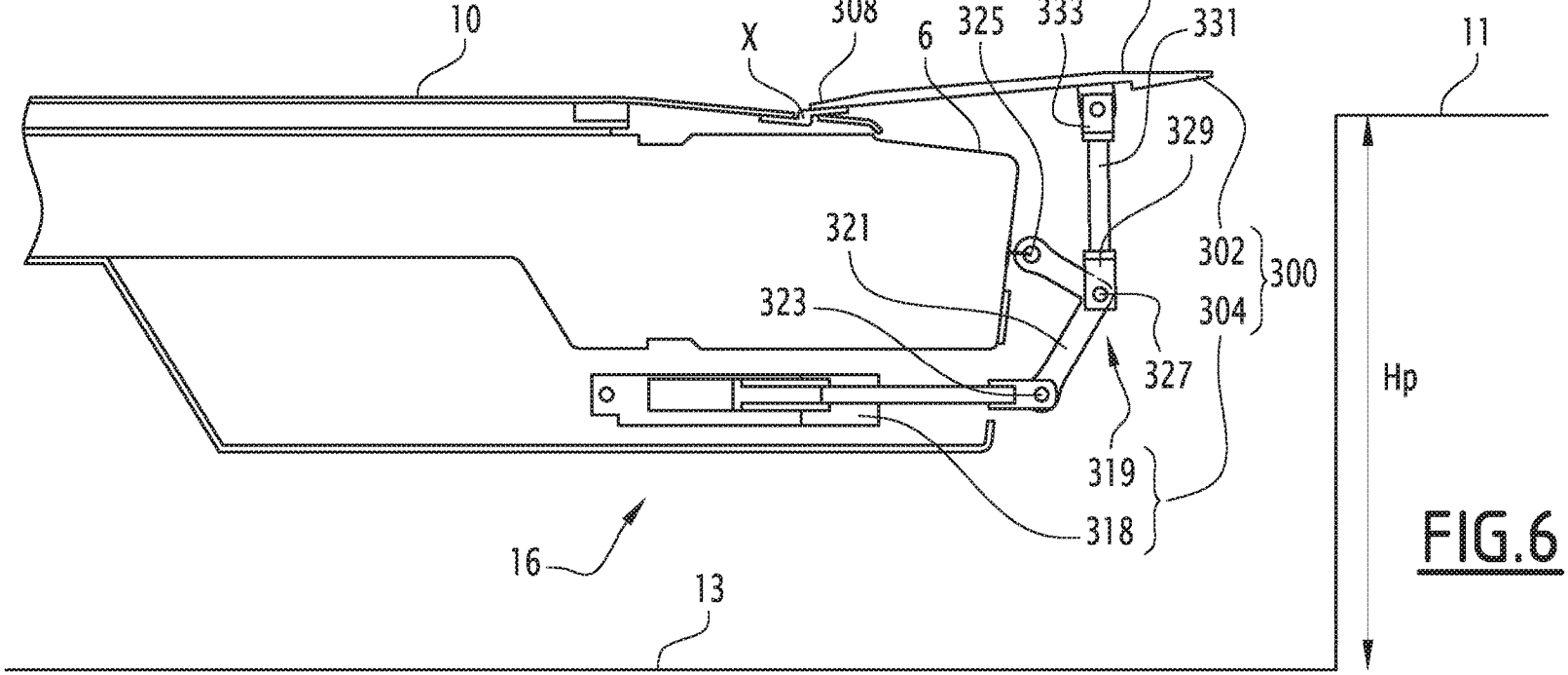
FIG. 6 shows a further example of an inventive vehicle boarding aid.

FIG. 6 shows a further example 300 of the vehicle boarding aid according to the invention. In this example, the actuator 318 of the vertical position adjusting device 304 is mounted to the underside 16 of the tram body 6. The actuator 318 can also be set up inside the carbody shell and pass through the car body structure.

The vertical position adjusting device 304 also comprises a linkage 319 connecting the actuator 318 to the entry threshold 302, said linkage 319 being adapted to convert a linear movement of the actuator 318 into a rotation of the entry threshold 302 around the horizontal pivoting axis X. Linkage 319 comprises an angled link 321 whose lower link end 323 is attached to the actuator 318, and whose upper link end 325 is attached to the tram body 6. The angle 327 of angled link 321 is linked to the lower rod end 329 of a rod 331. The upper rod end 333 of rod 331 is linked to the outer access end 306 of entry threshold 302.

Figure 7:
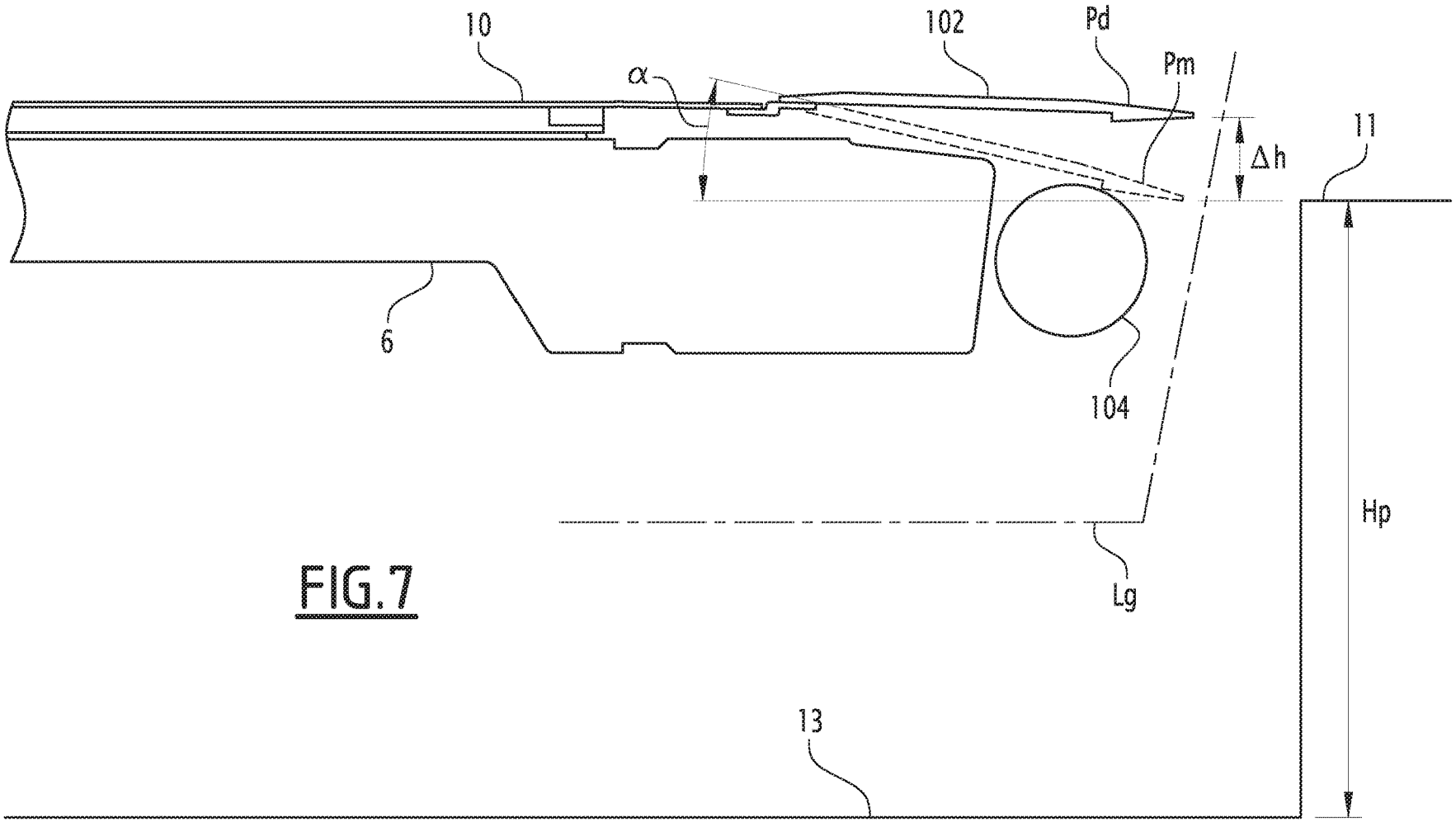
FIG. 7 illustrates the angular amplitude of the pivoting movement of an inventive entry threshold.

FIG. 7 illustrates the angular amplitude a of the entry threshold's pivoting movement. According to the invention, the access position Ap of entry threshold 102 can be adjusted between a substantially horizontal default position Pd and a maximum inclined position Pm. The access position Ap is set by the controller 120 to the default position Pd when the tram 1 is travelling between tram stations. When tram 1 enters a tram station and slows down, controller 120 already adjusts the vertical position of the entry threshold 102, 202, 302 to the upcoming station platform 11 so that the entry threshold already has the right inclination for bridging the vertical gap Gv between station platform 11 and the passenger area 7 when tram 1 comes to a complete stop. Furthermore, the entry threshold is brought back into the default position Pd once the tram 1 has started leaving the tram station. Hence, the adjustment of the inventive entry threshold does not increase the length of time that tram 1 has to stay in the tram station.

The access position Ap may be set to the maximum inclined position Pm when the vertical gap between the platform 11 and the entrance floor 10 is at a maximum. Preferably, the angle $\alpha$ is less than or equal to 16°. This corresponds e.g. to a maximum height adjustment $\Delta h$ of around 45 mm.

The invention claimed is:

1. A railway vehicle for passenger transport comprising a vehicle body, said vehicle body comprising:

a passenger entrance area; and a vehicle boarding aid for facilitating passengers' access to the passenger entrance area, wherein the vehicle boarding aid comprises:

a movable entry threshold arranged in an access position facilitating passengers' access to the passenger entrance area; and a vertical position adjusting device for vertically adjusting the access position of the entry threshold as a function of a potential vertical gap between a station platform and the passenger entrance area, wherein said entry threshold is fixedly arranged in said access position in all operating states of the railway vehicle.

2. The railway vehicle of claim 1, wherein the entry threshold is adapted to remain within the railway vehicle's loading gauge in all operating states of the railway vehicle.

3. The railway vehicle of claim 1, said entry threshold comprising an outer access end for stepping into the passenger entrance area, and an inner pivot end about which it can pivot around a horizontal axis to vertically adjust the access position of the entry threshold.

4. The railway vehicle of claim 3, wherein said passenger entrance area comprises an entrance floor and said inner pivot end is attached to the vehicle body in the area of the entrance floor.

5. The railway vehicle of claim 3, wherein the vertical position adjusting device is adapted to act on the entry threshold's outer access end.

6. The railway vehicle of claim 3, wherein an angular amplitude of the entry threshold's pivoting movement is less than 16°.

7. The railway vehicle of claim 1, wherein the vertical position adjusting device is arranged below the entry threshold.

8. The railway vehicle of claim 1, wherein the vertical position adjusting device comprises an actuator, such as an electric jack, a hydraulic cylinder or a pneumatic cylinder.

9. The railway vehicle of claim 8, wherein the actuator is attached to an outer side wall of the vehicle body.

10. The railway vehicle of claim 8, wherein the actuator is attached to the underside of the vehicle body.

11. The railway vehicle of claim 8, wherein the vertical position adjusting device comprises a linkage connecting the actuator to the entry threshold, said linkage being adapted to convert a movement of the actuator into a vertical displacement of the entry threshold.

12. The railway vehicle of claim 8, wherein the actuator is attached to an outer wall of the vehicle body via a ball joint.

13. The railway vehicle of claim 1 any, the railway vehicle being a tram, and in particular a low floor tram.

14. The railway vehicle of claim 1, further comprising:

a vehicle body suspension supporting the vehicle body, said vehicle body suspension being adapted to expand or collapse vertically as a function of the vehicle body's passenger load;

a sensor arrangement adapted to provide a measure for the vehicle body's passenger load; and a controller adapted to control the vertical position adjusting device as a function of the measure provided by the sensor arrangement.

15. A method of vertically adjusting the access position of the entry threshold of the railway vehicle of claim 14, comprising the steps of:

keeping the access position of the entry threshold at a default height when the railway vehicle is travelling from a first railway station having a first station platform to a second railway station having a second station platform;

using said sensor arrangement, measuring the vehicle body's passenger load and thus the size of the vehicle body suspension's current collapse;

when the railway vehicle has stopped at the second railway station, controlling the vertical position adjusting device to vertically adjust the access position of the entry threshold as a function of the measured passenger load, thus compensating a potential vertical gap between the passenger entrance area and the second station platform; and when the railway vehicle leaves the second railway station, controlling the vertical position adjusting device to move the entry threshold back to the access position's default height.

16. A railway vehicle for passenger transport comprising a vehicle body, said vehicle body comprising:

a passenger entrance area; and a vehicle boarding aid for facilitating passengers' access to the passenger entrance area, wherein the vehicle boarding aid comprises:

a movable entry threshold arranged in an access position facilitating passengers' access to the passenger entrance area; and a vertical position adjusting device for vertically adjusting the access position of the entry threshold as a function of a potential vertical gap between a station platform and the passenger entrance area, wherein said entry threshold is fixedly arranged in said access position in all operating states of the railway vehicle, and wherein said entry threshold comprises an outer access end for stepping into the passenger entrance area, and an inner pivot end about which it can pivot around a horizontal axis to vertically adjust the access position of the entry threshold.

17. A railway vehicle for passenger transport comprising a vehicle body, said vehicle body comprising:

a passenger entrance area; and a vehicle boarding aid for facilitating passengers' access to the passenger entrance area, wherein the vehicle boarding aid comprises:

a movable entry threshold arranged in an access position facilitating passengers' access to the passenger entrance area; and a vertical position adjusting device for vertically adjusting the access position of the entry threshold as a function of a potential vertical gap between a station platform and the passenger entrance area, wherein said entry threshold is fixedly arranged in said access position in all operating states of the railway vehicle, wherein the vertical position adjusting device has a supporting end attached to an outer side wall of the vehicle body and can linearly expand and contracts to modify a distance D between the movable entry threshold and the supporting end.

* * * * *